US011944128B2

(12) United States Patent
Lee et al.

(10) Patent No.: US 11,944,128 B2
(45) Date of Patent: Apr. 2, 2024

(54) APPARATUS FOR GENERATING AEROSOLS AND METHOD FOR CLEANING THE SAME

(71) Applicant: KT&G CORPORATION, Daejeon (KR)

(72) Inventors: Jae Min Lee, Siheung-si (KR); Jong Sub Lee, Seongnam-si (KR); Dae Nam Han, Daejeon (KR); Paul Joon Sunwoo, Seoul (KR)

(73) Assignee: KT&G CORPORATION, Daejeon (KR)

( * ) Notice: Subject to any disclaimer, the term of this patent is extended or adjusted under 35 U.S.C. 154(b) by 450 days.

(21) Appl. No.: 16/753,917

(22) PCT Filed: May 9, 2019

(86) PCT No.: PCT/KR2019/005544

§ 371 (c)(1),
(2) Date: Apr. 6, 2020

(87) PCT Pub. No.: WO2020/032350

PCT Pub. Date: Feb. 13, 2020

(65) Prior Publication Data

US 2020/0359699 A1 Nov. 19, 2020

(30) Foreign Application Priority Data

Aug. 7, 2018 (KR) ..... 10-2018-0092051

(51) Int. Cl.
*A24F 40/60* (2020.01)
*A24F 40/53* (2020.01)
(Continued)

(52) U.S. Cl.
CPC ..... *A24F 40/60* (2020.01); *A24F 40/53* (2020.01); *A24F 40/57* (2020.01); *A24F 40/85* (2020.01)

(58) Field of Classification Search
CPC ..... A24F 40/85; A24F 40/53; A24F 40/57
See application file for complete search history.

(56) References Cited

U.S. PATENT DOCUMENTS 4,908,760 A * 3/1990 Sinn ..... F24C 14/02 219/494
5,878,752 A * 3/1999 Adams ..... A24F 40/465 131/194
(Continued)

FOREIGN PATENT DOCUMENTS

CN 104188107 A 12/2014
CN 106231931 A 12/2016
(Continued)

OTHER PUBLICATIONS

Communication dated Feb. 14, 2022 from The State Intellectual Property Office of P.R. of China in Application No. 201980004827.0.
(Continued)

*Primary Examiner* — Anthony Calandra
(74) *Attorney, Agent, or Firm* — Sughrue Mion, PLLC

(57) ABSTRACT

Provided is a method of cleaning an aerosol generating device, the method including: receiving a user input for performing a cleaning operation; obtaining information about a performance history of the cleaning operation in response to the user input; setting a mode of the cleaning operation to one of a plurality of cleaning modes based on the information about the performance history; and performing the cleaning operation according to the set cleaning mode.

11 Claims, 10 Drawing Sheets

(51) Int. Cl.
*A24F 40/57* (2020.01)
*A24F 40/85* (2020.01)

(56) References Cited

U.S. PATENT DOCUMENTS

| | | | | |
|---|---|---|---|---|
| 6,392,204 | B2 * | 5/2002 | Corda | F24C 14/02 219/492 |
| 9,854,844 | B2 | 1/2018 | Plojoux et al. | |
| 10,398,175 | B2 | 9/2019 | Thorens | |
| 2002/0096510 | A1 * | 7/2002 | Metcalfe | F24C 14/02 219/492 |
| 2010/0163063 | A1 * | 7/2010 | Fernando | A24F 40/50 131/330 |
| 2015/0359263 | A1 | 12/2015 | Bellinger | |
| 2017/0112193 | A1 | 4/2017 | Chen | |
| 2017/0188634 | A1 | 7/2017 | Plojoux et al. | |
| 2018/0043114 | A1 * | 2/2018 | Bowen | A61M 15/003 |
| 2018/0199627 | A1 * | 7/2018 | Bowen | A24D 3/17 |

FOREIGN PATENT DOCUMENTS

| | | | |
|---|---|---|---|
| CN | 107373757 | A | 11/2017 |
| CN | 108323824 | A | 7/2018 |
| EP | 2609821 | A1 | 7/2013 |
| EP | 3098738 | A1 | 11/2016 |
| EP | 3 136 887 | B1 | 2/2018 |
| KR | 1999-0081973 | A | 11/1999 |
| KR | 10-2014-0109455 | A | 9/2014 |
| KR | 10-2014-0116381 | A | 10/2014 |
| KR | 10-2017-0095212 | A | 8/2017 |
| KR | 10-2017-0134773 | A | 12/2017 |
| KR | 10-2018-0070443 | A | 6/2018 |
| WO | 98/23171 | A1 | 6/1998 |
| WO | 2013/102612 | A2 | 7/2013 |
| WO | 2013098411 | A1 | 7/2013 |
| WO | 2019/088615 | A2 | 5/2019 |

OTHER PUBLICATIONS

Extended European Search Report dated Dec. 1, 2021 in European Application No. 19847701.0.
Korean Office Action dated Jan. 3, 2020 issued by the Korean Intellectual Property Office in Application No. 10-2018-0092051.
Int. Search Report dated Aug. 7, 2019 issued by the Int. Searching Authority in Application No. PCT/KR2019/005544 (PCT/ISA/210).
Written Opinion dated Aug. 7, 2019 issued by the Int. Searching Authority in Application No. PCT/KR2019/005544 (PCT/ISA/237).

* cited by examiner

APPARATUS FOR GENERATING AEROSOLS AND METHOD FOR CLEANING THE SAME

This is a National Stage of International Application No. PCT/KR2019/005544 filed May 9, 2019, claiming priority based on Korean Patent Application No. 10-2018-0092051 filed Aug. 7, 2018, the contents of all of which are incorporated herein by reference in their entirety.

TECHNICAL FIELD

The disclosure relates to an aerosol generating device and a method of cleaning the aerosol generating device.

BACKGROUND ART

Recently, the demand for alternative methods to overcome the shortcomings of general cigarettes has increased. For example, there is an increasing demand for a method of generating aerosol by heating an aerosol generating material in cigarettes, rather than by burning cigarettes. Accordingly, studies on a heating-type cigarette and a heating-type aerosol generating device have been actively conducted.

An aerosol generating device that implements a smoking operation by heating an aerosol generating material in a cigarette inserted therein through a heater is an example of a heating-type aerosol generating device. Meanwhile, a typical aerosol generating device could perform a cleaning operation of heating a heater to a high temperature to remove material attached to the heater in order to keep up the good performance for a long time. A cleaning operation shows different effects depending on the frequency or history of cleaning operations or the performance history of cleaning operations. However, general aerosol generating devices have performed cleaning operations without considering the frequency or history of cleaning operations. As such, there are problems that it is difficult to obtain a consistent effect for each cleaning operation, and unnecessary power is consumed.

DESCRIPTION OF EXEMPLARY EMBODIMENTS

Solution to Problem

Various exemplary embodiments relate to an aerosol generating device and a method of cleaning the aerosol generating device. For example, a method of cleaning an aerosol generating device includes: receiving a user input for performing a cleaning operation for heating a heater included in the aerosol generating device to remove material attached on the heater; obtaining information about a performance history of the cleaning operation previously performed by the aerosol generating device, in response to the user input; setting a mode of the cleaning operation to one of a plurality of cleaning modes based on the information about the performance history; and performing the cleaning operation according to the set cleaning mode. Technical problems to be achieved by the disclosure are not limited to the above-described technical problems, and other technical problems may be inferred from the following exemplary embodiments.

Advantageous Effects of Disclosure

The disclosure provides an aerosol generating device and a method of cleaning the aerosol generating device. More specifically, the method and device according to the disclosure may obtain, when a user input for performing a cleaning operation is received, information about a performance history of the cleaning operation previously performed by the aerosol generating device, set a mode of the cleaning operation to one of a plurality of cleaning modes based on the information about the performance history, and perform the cleaning operation according to the set cleaning mode.

According to an example, the method and device according to the disclosure may determine, when a cleaning operation is performed in a normal cleaning mode, a time at which an effect of cleaning is reduced based on information about a performance history of the cleaning operation, and perform the cleaning operation in an enhanced cleaning mode of providing greater total amount of heat than the normal cleaning mode when a user input for performing a cleaning operation is received at the corresponding time. As such, according to the device and method of the disclosure, because a plurality of cleaning modes of providing different total amount of heat according to heating patterns are provided, a consistent cleaning effect may be obtained regardless of a cleaning frequency or a performance history of a cleaning operation.

Also, because an idle mode is provided to prevent an excessive number of cleaning operations from being performed within a specific period, the method and device according to the disclosure may minimize unnecessary power consumption.

BEST MODE

Figure 1:
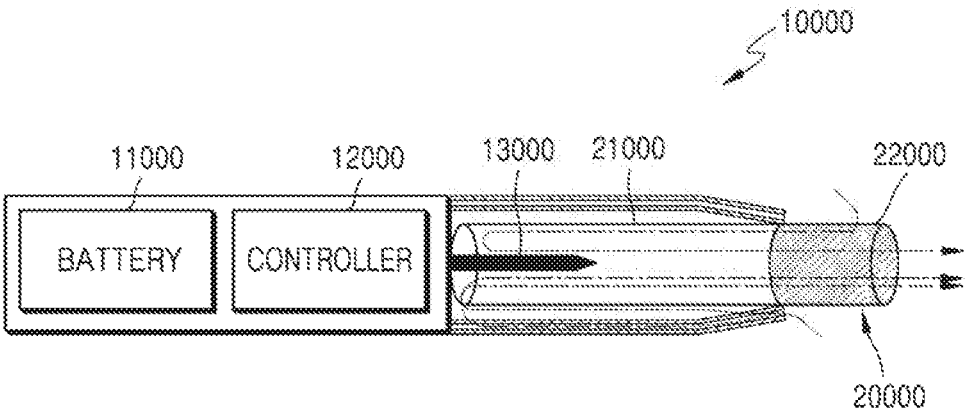
FIG. 1 is a diagram illustrating an exemplary embodiment in which a cigarette is inserted into an aerosol generating device.

A method of cleaning an aerosol generating device, according to an aspect, includes: receiving a user input for performing a cleaning operation to remove material attached on a heater in the aerosol generating device by heating the heater; obtaining information about a performance history of the cleaning operation previously performed by the aerosol generating device, in response to the user input; setting a mode of the cleaning operation to one of a plurality of cleaning modes based on the information about the performance history; and performing the cleaning operation according to the set cleaning mode.

The information about the performance history may include at least one of a number of times that the cleaning operation has been performed during a first period and a number of times that the cleaning operation has been performed during a second period that is longer than the first period.

Each of the first period and the second period may include at least one of a pre-set period, a period corresponding to a pre-set number of uses, a period corresponding to a pre-set number of puffs, and a period corresponding to a pre-set number of times of heating.

The plurality of cleaning modes may include a normal cleaning mode and an enhanced cleaning mode, and the enhanced cleaning mode may provide a greater total amount of heat to the heater than the normal cleaning mode.

The plurality of cleaning modes may provide different total amount of heat to the heater according to a heating pattern for heating the heater.

The heating pattern may be determined based on at least one of a total heating time of the heater, a highest heating temperature of the heater, an inclination of a heating temperature of the heater, a number of times that the heater is heated to a specific temperature or higher, and a period during which the heater is heated at a specific temperature.

The total heating time may have a range of 25 seconds to 60 seconds, and the highest heating temperature may have a range of 450° C. to 600° C.

The setting of the mode of the cleaning operation to the one of the plurality of cleaning modes may include: setting the cleaning operation to a normal cleaning mode based on a number of times that the cleaning operation has been performed during a first period being is greater than or equal to a first threshold number; and setting the cleaning operation to an enhanced cleaning mode based on the number of times that the cleaning operation has been performed during the first period being less than the first threshold number.

The enhanced cleaning mode may include a first enhanced cleaning mode and a second enhanced cleaning mode that provides a greater total amount of heat to the heater than the first enhanced cleaning mode, and the setting of the cleaning operation to the enhanced cleaning mode may include: setting the cleaning operation to the first enhanced cleaning mode based on the number of times that the cleaning operation has been performed during the first period being greater than or equal to a second threshold number and less than the first threshold number; and setting the cleaning operation to the second enhanced cleaning mode based on the number of times that the cleaning operation has been performed during the first period being less than the second threshold number.

The setting of the mode of the cleaning operation to the one of the plurality of cleaning modes may include: setting the cleaning operation to a normal cleaning mode based on a number of times that the cleaning operation has been performed during a first period being greater than or equal to a first threshold number; setting the cleaning operation to a first enhanced cleaning mode based on the number of times that the cleaning operation has been performed during the first period being less than the first threshold number of times and a number of times that the cleaning operation has been performed during a second period being greater than or equal to the first threshold number; and setting the cleaning operation to a second enhanced cleaning mode based on the number of times that the cleaning operation has been performed during the second period being less than the first threshold number.

The setting of the mode of the cleaning operation to the one of the plurality of cleaning modes may include setting the cleaning operation to an idle mode based on a number of times that the cleaning operation has been performed during a first period being greater than or equal to a third threshold number, and wherein the aerosol generating device outputs notification information without performing the cleaning operation in the idle mode.

Also, a computer-readable recording medium according to another aspect may include a recording medium storing at least one program including instructions for executing the above-described method.

Also, an aerosol generating device according to still another aspect includes: a battery configured to supply power to the aerosol generating device; a heater configured to be heated when the power is supplied from the battery; a controller configured to control the battery and the heater, wherein the controller is further configured to receive a user input for performing a cleaning operation of heating the heater to remove material attached on the heater, obtain information about a performance history of the cleaning operation previously performed by the aerosol generating device, in response to the user input, set a mode of the cleaning operation to one of a plurality of cleaning modes based on the information about the performance history, and perform the cleaning operation according to the set cleaning mode.

Mode of Disclosure

With respect to the terms in the various exemplary embodiments, the general terms which are currently and widely used are selected in consideration of functions of structural elements in the various exemplary embodiments of the present disclosure. However, meanings of the terms can be changed according to intention, a judicial precedence, the appearance of a new technology, and the like. In addition, in certain cases, a term which is not commonly used can be selected. In such a case, the meaning of the term will be described in detail at the corresponding portion in the description of the present disclosure. Therefore, the terms used in the various exemplary embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the exemplary embodiments set forth herein.

Hereinafter, exemplary embodiments of the present disclosure will be described in detail with reference to the drawings.

FIG. 1 is a diagram illustrating an example in which a cigarette is inserted into an aerosol generating device.

Referring to FIG. 1, the aerosol generating device 10000 may include a battery 11000, a controller 12000, and a heater 13000. Also, the cigarette 20000 may be inserted into an inner space of the aerosol generating device 10000.

FIG. 1 shows the aerosol generating device 10000 with some elements related to the exemplary embodiment. Therefore, it will be understood by one of ordinary skill in the art related to the present exemplary embodiment that other general-purpose components may be further included in the aerosol generating device 10000, in addition to the components illustrated in FIG. 1.

FIG. 1 illustrates that the battery 11000, the controller 12000, and the heater 13000 are arranged in series, but the arrangement of these are not limited thereto. In other words, according to the design of the aerosol generating device 10000, the arrangements of the battery 11000, the controller 12000, and the heater 13000 may be modified.

When the cigarette 20000 is inserted into the aerosol generating device 10000, the aerosol generating device 10000 heats the heater 13000. The temperature of an aerosol generating material in the cigarette 20000 is raised by the heated heater 13000, and thus aerosol is generated. The generated aerosol is delivered to a user through a filter 22000 of the cigarette 20000.

According to necessity, even when the cigarette 20000 is not inserted into the aerosol generating device 10000, the aerosol generating device 10000 may heat the heater 13000. For example, aerosol generating device 10000 could perform a cleaning operation of heating the heater 13000 to a high temperature to remove material attached to the heater 13000, without the cigarette 20000 being inserted into the aerosol generating device 10000.

The battery 11000 may supply power to be used for the aerosol generating device 10000 to operate. For example, the battery 11000 may supply power for heating the heater 13000 and supply power for operating the controller 12000. Also, the battery 11000 may supply power for operations of a display, a sensor, a motor, etc. mounted in the aerosol generating device 10000.

The controller 12000 may generally control operations of the aerosol generating device 10000. In detail, the controller 12000 controls not only operations of the battery 11000 and the heater 13000, but also operations of other components included in the aerosol generating device 10000. Also, the controller 12000 may check a state of each of the components of the aerosol generating device 10000 to determine whether or not the aerosol generating device 10000 is able to operate.

The controller 12000 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13000 is heated by power supplied from the battery 11000. For example, when the cigarette 20000 is inserted into the aerosol generating device 10000, the heater 13000 may be located inside the cigarette 20000. Thus, the heated heater 13000 may increase a temperature of an aerosol generating material in the cigarette 20000.

The heater 13000 may include an electro-resistive heater. For example, the heater 13000 may include an electrically conductive track, and the heater 13000 may be heated when currents flow through the electrically conductive track. However, the heater 13000 is not limited to the example described above and may be implemented using any other heaters which are capable of being heated to a desired temperature. Here, the desired temperature may be pre-set in the aerosol generating device 10000 or may be set manually by a user.

FIG. 1 illustrates that the heater 13000 is inserted into the cigarette 20000, but the position of the heater 13000 is not limited thereto. For example, the heater 13000 may include a tube-type heating element, a plate-type heating element, a needle-type heating element, or a rod-type heating element.

Also, the aerosol generating device 10000 may include a plurality of heaters 13000. Here, the plurality of heaters 13000 may be inserted into the cigarette 20000. Also, some of the plurality of heaters 13000 may be inserted into the cigarette 20000, and the others may be arranged outside the cigarette 20000. In addition, the shape of the heater 13000 is not limited to the shape illustrated in FIG. 1, and may include various shapes.

The aerosol generating device 10000 may further include general-purpose components in addition to the battery 11000, the controller 12000, and the heater 13000. For example, the aerosol generating device 10000 may include a display capable of outputting visual information and/or a motor for outputting haptic information. Also, the aerosol generating device 10000 may include at least one sensor (a puff detecting sensor, a temperature detecting sensor, a cigarette insertion detecting sensor, etc.).

Also, the aerosol generating device 10000 may be formed to have a structure that allows external air to be introduced or internal air to be discharged even while the cigarette 20000 is inserted into the aerosol generating device 10000.

Although not illustrated in FIG. 1, the aerosol generating device 10000 and an additional cradle may form together a system. For example, the cradle may be used to charge the battery 11000 of the aerosol generating device 10000. The heater 13000 may be heated when the cradle and the aerosol generating device 10000 are coupled to each other.

The cigarette 20000 may be similar to a general combustive cigarette. For example, the cigarette 20000 may be divided into a first portion 21000 including an aerosol generating material and a second portion 22000 including a filter or the like. Alternatively, the second portion 22000 of the cigarette 20000 may also include an aerosol generating material. For example, an aerosol generating material made in the form of granules or capsules may be inserted into the second portion 22000.

The first portion 21000 may be completely inserted into the aerosol generating device 10000, and the second portion 22000 may be exposed to the outside. In some exemplary embodiments, only a portion of the first portion 21000 may be inserted into the aerosol generating device 10000. Otherwise, a portion of the first portion 21000 and a portion of the second portion 22000 may be inserted into the aerosol generation device 10000. The user may puff aerosol while holding the second portion 22000 by the mouth of the user. In this case, the aerosol is generated by the external air passing through the first portion 21000, and the generated aerosol passes through the second portion 22000 and is delivered to the user's mouth.

For example, the external air may flow into at least one air passage formed in the aerosol generating device 10000. For example, opening and closing of the air passage and/or a size of the air passage may be adjusted by the user. Accordingly, the amount and smoothness of smoke may be adjusted by the user. As another example, the external air may flow into the cigarette 20000 through at least one hole formed in a surface of the cigarette 20000.

Hereinafter, an example of the cigarette 20000 will be described with reference to FIG. 2.

Figure 2:
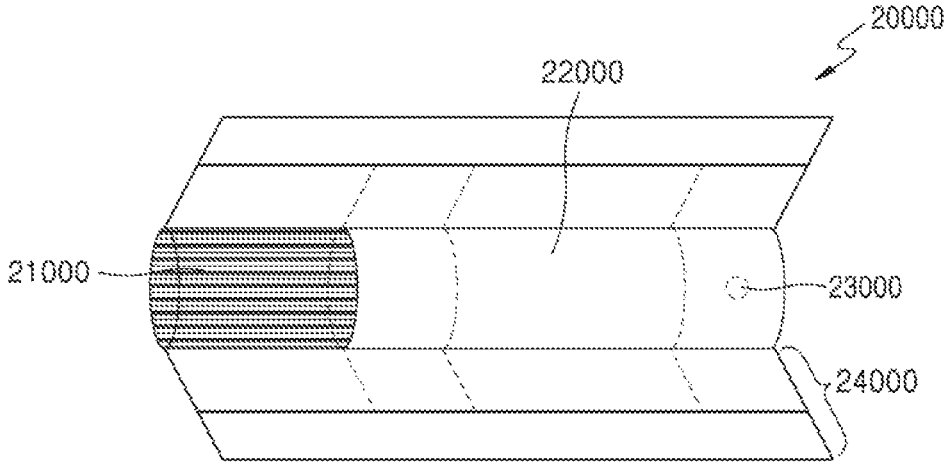
FIG. 2 shows a view showing an example of the cigarette.

FIG. 2 shows a view showing an example of a cigarette.

Referring to FIG. 2, the cigarette 20000 includes a tobacco rod 21000 and a filter rod 22000. The first portion 21000 described above with reference to FIG. 1 includes the tobacco rod 21000, and the second portion 22000 includes the filter rod 22000.

The filter rod 22000 illustrated in FIG. 2 is illustrated as a single segment, but is not limited thereto. In other words, the filter rod 22000 may include a plurality of segments. For example, the filter rod 22000 may include a first segment configured to cool aerosol and a second segment configured to filter a certain component included in the aerosol. Also, as necessary, the filter rod 22000 may further include at least one segment configured to perform other functions.

The cigarette 20000 may be packaged using at least one wrapper 24000. The wrapper 24000 may have at least one hole through which external air may be introduced or internal air may be discharged. For example, the cigarette 20000 may be packaged using one wrapper 24000. As another example, the cigarette 20000 may be doubly packaged using at least two wrappers 24000. For example, the tobacco rod 21000 may be packaged using a first wrapper, and the filter rod 22000 may be packaged using a second wrapper. Also, the tobacco rod 21000 and the filter rod 22000, which are respectively packaged using separate wrappers, may be coupled to each other, and the entire cigarette 20000 may be packaged using a third wrapper. When each of the tobacco rod 21000 and the filter rod 22000 includes a plurality of segments, each segment may be packaged using a separate wrapper. Also, the entire cigarette 20000 including the plurality of segments, which are respectively packaged using the separate wrappers and which are coupled to each other, may be re-packaged using another wrapper.

The tobacco rod 21000 may include an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 21000 may include other additives, such as flavors, a wetting agent, and/or organic acid. Also, the tobacco rod 21000 may include a flavored liquid, such as menthol or a moisturizer, which is injected to the tobacco rod 21000.

The tobacco rod 21000 may be manufactured in various forms. For example, the tobacco rod 21000 may be formed as a sheet or a strand. Also, the tobacco rod 21000 may be formed as a pipe tobacco, which is formed of tiny bits cut from a tobacco sheet. Also, the tobacco rod 21000 may be surrounded by a heat conductive material. For example, the heat-conducting material may be, but is not limited to, a metal foil such as aluminum foil. For example, the heat conductive material surrounding the tobacco rod 21000 may uniformly distribute heat transmitted to the tobacco rod 21000, and thus, the heat conductivity applied to the tobacco rod may be increased and taste of the tobacco may be improved. Also, the heat conductive material surrounding the tobacco rod 21000 may function as a susceptor heated by the induction heater. Here, although not illustrated in the drawings, the tobacco rod 21000 may further include an additional susceptor, in addition to the heat conductive material surrounding the tobacco rod 21000.

The filter rod 22000 may include a cellulose acetate filter. Shapes of the filter rod 22000 are not limited. For example, the filter rod 22000 may include a cylinder-type rod or a tube-type rod having a hollow inside. Also, the filter rod 22000 may include a recess-type rod. When the filter rod 22000 includes a plurality of segments, at least one of the plurality of segments may have a different shape.

The filter rod 22000 may be formed to generate flavors. For example, a flavoring liquid may be injected onto the filter rod 22000, or an additional fiber coated with a flavoring liquid may be inserted into the filter rod 22000.

Also, the filter rod 22000 may include at least one capsule 23000. Here, the capsule 23000 may generate a flavor or aerosol. For example, the capsule 23000 may have a configuration in which a liquid containing a flavoring material is wrapped with a film. For example, the capsule 23000 may have a spherical or cylindrical shape, but is not limited thereto.

When the filter rod 22000 includes a segment configured to cool the aerosol, the cooling segment may include a polymer material or a biodegradable polymer material. For example, the cooling segment may include pure polylactic acid alone, but the material for forming the cooling segment is not limited thereto. In some exemplary embodiments, the cooling segment may include a cellulose acetate filter having a plurality of holes. However, the cooling segment is not limited to the above-described example and any other cooling segment that is capable of cooling the aerosol may be used.

Figure 3:
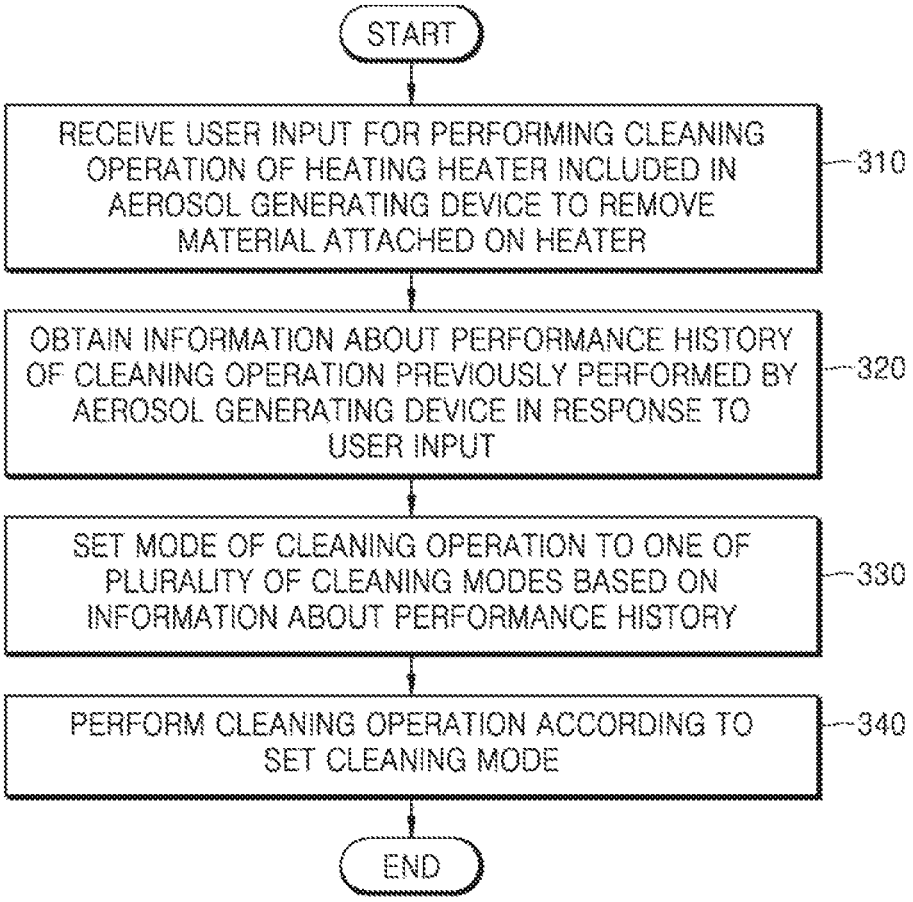
FIG. 3 is a flowchart showing an example of a method of cleaning an aerosol generating device according to some exemplary embodiments.

FIG. 3 is a flowchart showing an example of a method of cleaning an aerosol generating device according to some exemplary embodiments.

The method of FIG. 3 may be performed by the aerosol generating device 10000. For example, the method of FIG. 3 may be performed by the controller 12000 included in the aerosol generating device 10000, although not limited thereto.

Referring to FIG. 3, in operation 310, the controller 12000 may receive a user input for performing a cleaning operation to remove material attached on the heater 13000 by heating the heater 13000 included in the aerosol generating device 10000. For example, the aerosol generating device 10000 may further include a button (not shown) that can be controlled by a user, and the controller 12000 may receive a user input for performing a cleaning operation through the button. However, exemplary embodiments are not limited thereto, and the controller 12000 may receive a user input for performing a cleaning operation though another means.

In operation 320, the controller 12000 may obtain information about a performance history of cleaning operations previously performed by the aerosol generating device 10000, in response to the user input. According to an exemplary embodiment, the controller 12000 may obtain information about a performance history of a cleaning operation from a memory (not shown), in response to the user input. The controller 12000 may store the information about the performance history of the cleaning operation in the memory included in the aerosol generating device 10000, and may update the information whenever a cleaning operation is performed.

The information about the performance history may include at least one of a number of times that the cleaning operation has been performed during a first period and a number of times that the cleaning operation has been performed during a second period that is longer than the first period. Each of the first period and the second period may include at least one of a pre-set time period, a period corresponding to a pre-set number of uses, a period corresponding to a pre-set number of puffs, and a period corresponding to a pre-set number of times of heating.

According to an exemplary embodiment where each of the first period and the second period is a pre-set time period, the first period may be a week, and the second period may be a month. Also, in this case, the information about the performance history of the cleaning operation may include a number of times that the cleaning operation has been performed in a week and/or a number of times that the cleaning operation has been performed in a month. However, a week or a month is only an example, and each of the first period and the second period may correspond to other appropriate time.

According to another exemplary embodiment where each of the first period and the second period is a period corresponding to a pre-set number of uses, the first period may be a period correspond to 100 times of use, and the second period may be a period corresponding to 400 times of use. Also, the information about the performance history of the cleaning operation may include a number of times that the cleaning operation has been performed during 100 times of use of the aerosol generating device 10000 and/or a number of times that the cleaning operation has been performed during 400 times of use of the aerosol generating device 10000. Because using the aerosol generating device 10000 means smoking, the number of uses may correspond to a number of cigarettes consumed by the aerosol generating device 10000. Meanwhile, 100 times of use or 400 times of use is only an example, and each of the first period and the second period may be a period corresponding to other appropriate number of uses.

According to another exemplary embodiment where each of the first period and the second period is a period corresponding to a pre-set number of puffs, the first period may be a period corresponding to 1400 times of puffs, and the second period may be a period corresponding to 5600 times of puffs. Also, the information about the performance history of the cleaning operation may include the number of times that the cleaning operation has been performed during user's 1400 puffs through the aerosol generating device 10000 and/or the number of times that the cleaning operation has been performed during user's 5600 puffs through the aerosol generating device 10000. However, 1400 times or 5600 times is only an example, and each of the first period and the second period may be a period corresponding to other appropriate number of puffs. Each of the first period and the second period may be appropriately determined based on an average number of puffs per cigarette.

Meanwhile, each of the first period and the second period is not necessarily limited to the above-described examples. For example, each of the first period and the second period may be a period corresponding to a pre-set number of times of heating. The number of heating may indicate the number of times that the heater 13000 has been heated regardless of whether the heating has occurred by a smoking operation or by a cleaning operation. Also, each of the first period and the second period may be a period corresponding to a number of times that a user input has been received. For example, each of the first period and the second period may be a period corresponding to a specific number of times that a user has pressed the button.

In operation 330, the controller 12000 may set a mode of the cleaning operation to one of a plurality of cleaning modes based on the information about the performance history. The plurality of cleaning modes may include a normal cleaning mode and an enhanced cleaning mode. The enhanced cleaning mode may provide greater total amount of heat to the heater 13000 than the normal cleaning mode.

More specifically, if the number of times that the cleaning operation has been performed in the past during the first period is greater than or equal to a first threshold number, the controller 12000 may set the cleaning operation to the normal cleaning mode. On the other hand, if the number of times that the cleaning operation has been performed in the past during the first period is less than the first threshold number of times, the controller 12000 may set the cleaning operation to the enhanced cleaning mode. According to an exemplary embodiment, assuming that the first period is a period corresponding to 100 times of use and the first threshold number of times is 1, the controller 12000 may set the cleaning operation to the normal cleaning mode if the number of times that the cleaning operation has been performed during 100 times of use of the aerosol generating device 10000 is greater than or equal to one. Otherwise, the cleaning operation has never been performed during 100 times of use, the controller 12000 may set the cleaning operation to the enhanced cleaning mode. However, the first period used for setting a cleaning mode is not necessarily limited to the above example, and the first period may be a period corresponding to various parameters. Also, it will be easily understood by one of ordinary skill in the art that the first threshold number may be set to an appropriate number other than one.

Meanwhile, each of the plurality of cleaning modes may provide different total amount of heat depending on a heating pattern of the heater 13000. The heating pattern may correspond to a heating temperature graph of the heater 13000 over time when the heater 13000 is heated to perform a cleaning operation, and total amount of heat that is provided to the heater 13000 may correspond to a value obtained by integrating a heating temperature of the heater 13000 with respect to time. The heating pattern may be determined based on at least one of a total heating time, a highest heating temperature, an inclination of a heating temperature, the number of times that the heating temperature reaches a specific temperature or higher, and a time period during which a specific heating temperature is maintained. Hereinafter, a process of providing a different amount of heat to the heater 13000 based on a heating pattern in the normal cleaning mode and the enhanced cleaning mode will be described in more detail with reference to FIGS. 4 to 9.

FIGS. 4 to 9 show examples for describing the normal cleaning mode and the enhanced cleaning mode according to some exemplary embodiments.

Figure 4:
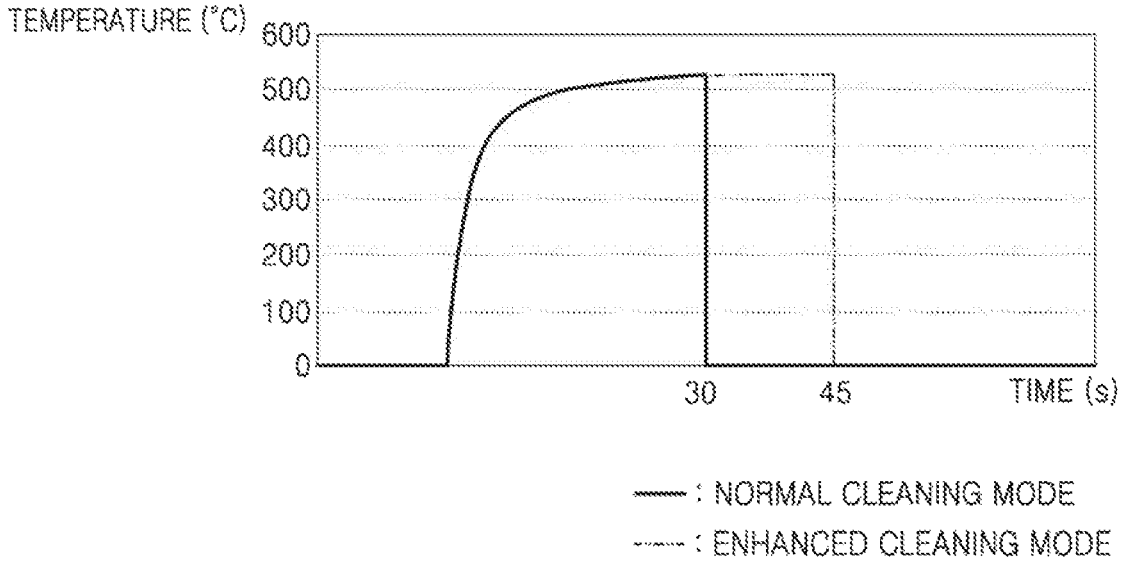
FIGS. 4 to 9 show examples for describing a normal cleaning mode and an enhanced cleaning mode according to some exemplary embodiments.

In the example of FIG. 4, the total amount of heat provided to the heater 13000 in the normal cleaning mode and the enhanced cleaning mode may be adjusted by adjusting a total heating time of the heater 13000. As shown in FIG. 4, the normal cleaning mode may be a cleaning mode of setting a highest heating temperature to 530° C. and heating the heater 13000 for 30 seconds, and the enhanced cleaning mode may be a cleaning mode of setting a highest heating temperature to 530° C. and heating the heater 13000 for 45 seconds. As such, the controller 12000 may adjust a total heating time of the heater 13000 such that a greater total amount of heat is transferred to the heater 13000 in the enhanced cleaning mode than in the normal cleaning mode.

Figure 5:
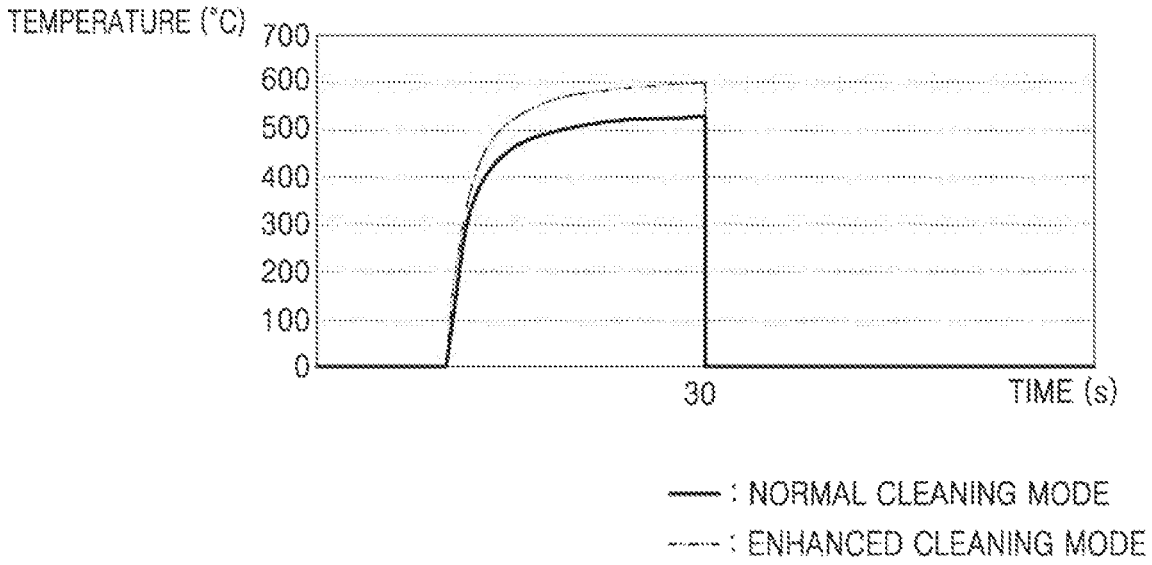

In the example of FIG. 5, the total amount of heat provided to the heater 13000 in the normal cleaning mode and the enhanced cleaning mode may be adjusted by adjusting a highest heating temperature of the heater 13000. As shown in FIG. 5, the normal cleaning mode may be a cleaning mode of setting a highest heating temperature to 530° C. and heating the heater 13000 for 30 seconds, and the enhanced cleaning mode may be a cleaning mode of setting a highest heating temperature to 600° C. and heating the heater 13000 for 30 seconds. As such, the controller 12000 may adjust a highest heating temperature of the heater 13000 such that a greater total amount of heat is transferred to the heater 13000 in the enhanced cleaning mode than in the normal cleaning mode.

Figure 6:
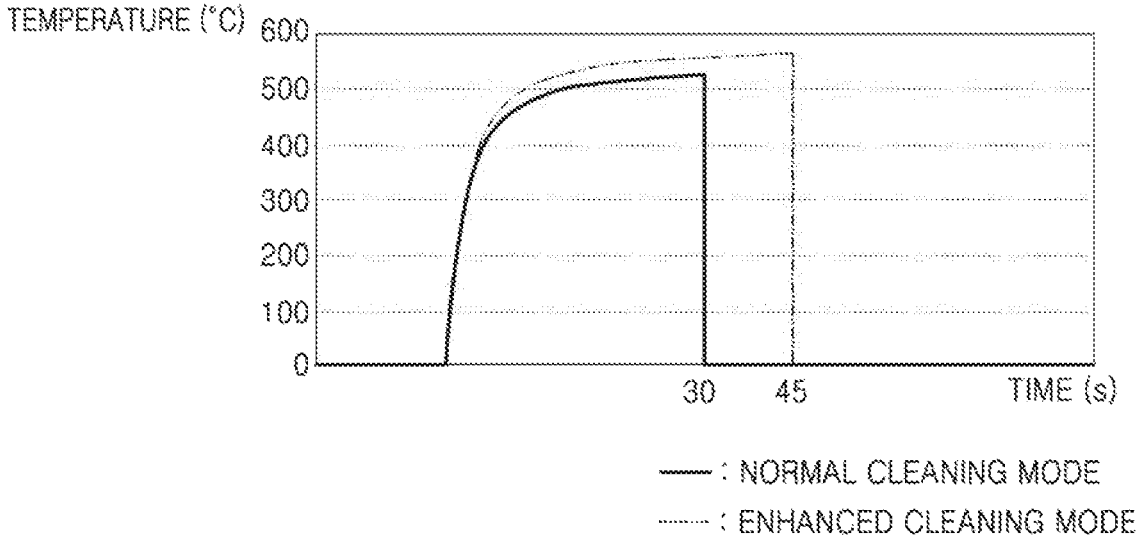

In the example of FIG. 6, the total amount of heat provided to the heater 13000 in the normal cleaning mode and the enhanced cleaning mode may be adjusted by adjusting both a total heating time of the heater 13000 and a highest heating temperature of the heater 13000. As shown in FIG. 6, the normal cleaning mode may be a cleaning mode of setting a highest heating temperature to 530° C. and heating the heater 13000 for 30 seconds, and the enhanced cleaning mode may be a cleaning mode of setting a highest heating temperature to 600° C. and heating the heater 13000 for 45 seconds. As such, the controller 12000 may adjust a total heating time of the heater 13000 and a highest heating temperature of the heater 13000 such that a greater total amount of heat is transferred to the heater 13000 in the enhanced cleaning mode than in the normal cleaning mode.

Figure 7:
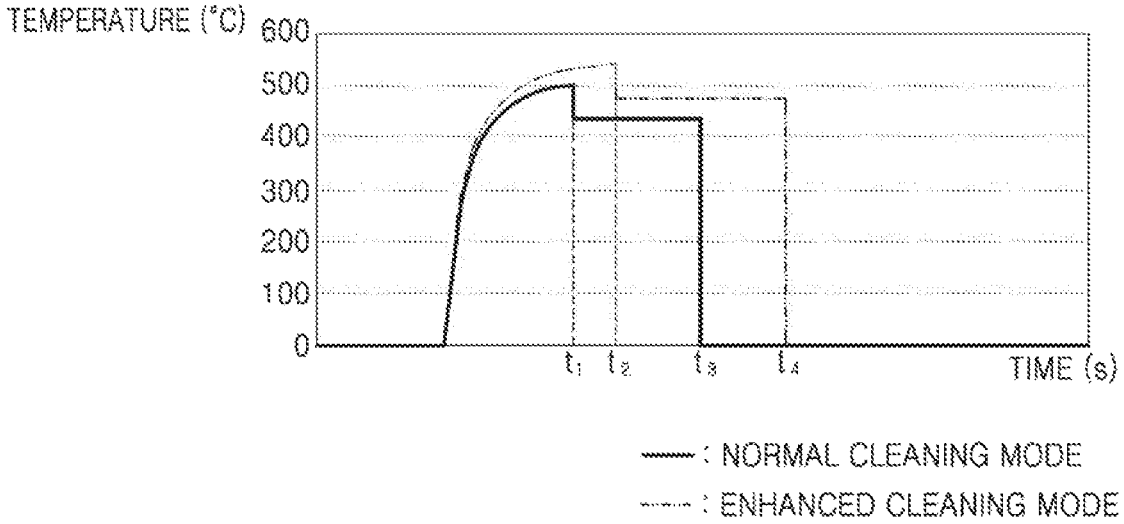

In the example of FIG. 7, the total amount of heat provided to the heater 13000 in the normal cleaning mode and the enhanced cleaning mode may be adjusted by adjusting a time period during which the heater 13000 is maintained at a specific temperature, in addition to a total heating time of the heater 13000 and a highest heating temperature of the heater 13000. As shown in FIG. 7, the normal cleaning mode may be a cleaning mode of controlling a heating temperature to reach a highest heating temperature of 500° C. at a time of t1, reducing the heating temperature to 430° C., and then maintaining the heating temperature at 430° C. until a time of t3. The enhanced cleaning mode may be a cleaning mode of controlling a heating temperature to reach a highest heating temperature of 530° C. at a time of t2, reducing the heating temperature to 480° C., and then maintaining the heating temperature at 480° C. until a time of t4. As such, the controller 12000 may adjust a time period during which the heater 13000 is maintained at a specific temperature, in addition to a total heating time of the heater 13000 and a highest heating temperature of the heater 13000, such that a greater total amount of heat is transferred to the heater 13000 in the enhanced cleaning mode than in the normal cleaning mode.

Figure 8:
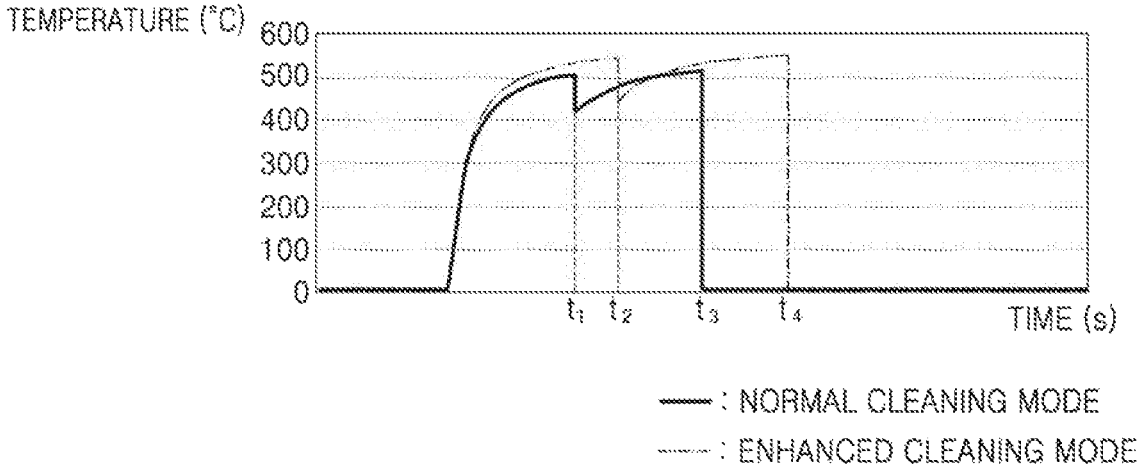

In the example of FIG. 8, the total amount of heat provided to the heater 13000 in the normal cleaning mode and the enhanced cleaning mode may be adjusted by adjusting the number of times that the heater 13000 is heated to a specific temperature or higher or by adjusting a time at which the heater 13000 is heated to the specific temperature or higher, in addition to a total heating time of the heater 13000 and a highest heating temperature of the heater 13000. As shown in FIG. 8, the normal cleaning mode may be a cleaning mode of heating the heater 13000 to 500° C. or higher at a time of t1 and then again heating the heater 13000 to 500° C. or higher at a time of t3. On the other hand, the enhanced cleaning mode may be a cleaning mode of heating the heater 13000 to 530° C. or higher at a time of t2 and then again heating the heater 13000 to 530° C. or higher at a time of t4. As such, the controller 12000 may adjust the number of times that the heater 13000 is heated to a specific temperature or higher or a time at which the heater 13000 is heated to the specific temperature or higher, in addition to a total heating time of the heater 13000 and a highest heating temperature of the heater 13000, such that a greater total amount of heat is transferred to the heater 13000 in the enhanced cleaning mode than in the normal cleaning mode.

Figure 9:
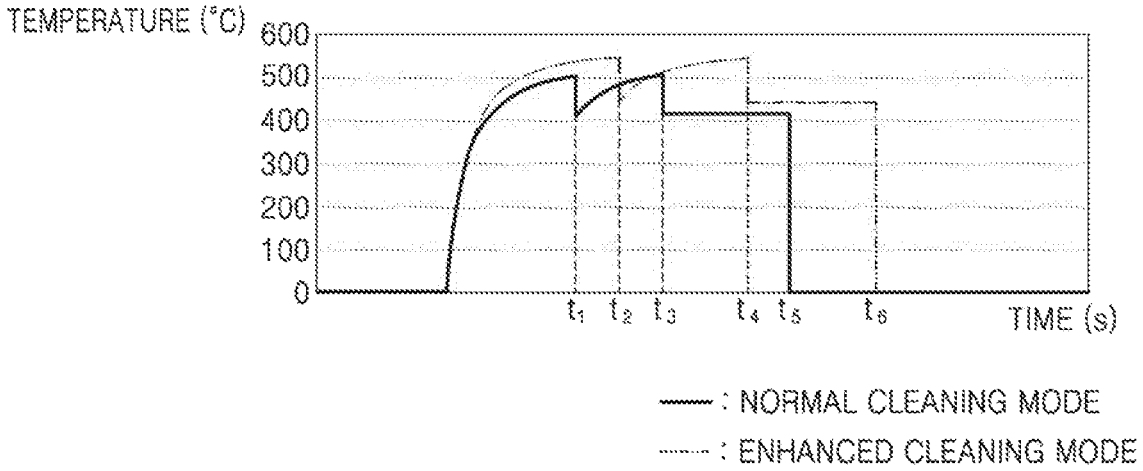

In the example of FIG. 9, the total amount of heat provided to the heater 13000 in the normal cleaning mode and the enhanced cleaning mode may be adjusted by adjusting a total heating time of the heater 13000, a highest heating temperature of the heater 13000, a time period during which the heater 13000 is maintained at a specific temperature, and the number of times that the heater 13000 is heated to a specific temperature or higher or a time at which the heater 13000 is heated to the specific temperature or higher. As shown in FIG. 9, the normal cleaning mode may be a cleaning mode of heating the heater 13000 to 500° C. or higher at a time of t1, then again heating the heater 13000 to 500° C. or higher at a time of t3, and maintaining the heater 13000 at a heating temperature of 410° C. from the time of t3 to a time of t5. On the other hand, the enhanced cleaning mode may be a cleaning mode of heating the heater 13000 to 530° C. or higher at a time of t2, then again heating the heater 13000 to 530° C. or higher at a time of t4, and maintaining the heater 13000 at a heating temperature of 430° C. from the time of t4 to a time of t6. As such, the controller 12000 may adjust a total heating time of the heater 13000, a highest heating temperature of the heater 13000, a time period during which the heater is maintained at a specific temperature, and a number of times that the heater 13000 is heated to a specific temperature or higher or a time at which the heater 13000 is heated to the specific temperature or higher, such that greater total amount of heat is transferred to the heater 13000 in the enhanced cleaning mode than in the normal cleaning mode.

As shown from the above-described examples, the normal cleaning mode and the enhanced cleaning mode may provide a different total amount of heat to the heater 13000 according to various heating patterns of heating the heater 13000. Meanwhile, the total heating time and the highest heating temperature of the heater 13000 may be set preferably within a range in which the aerosol generating device 10000 is not deformed. According to an example, the total heating time may have a range of 25 seconds to 60 seconds, and the highest heating temperature may have a range of 450° C. to 600° C. The controller 12000 may adjust the total heating time and the highest heating temperature within the above-mentioned ranges, thereby adjusting the total amount of heat that is transferred to the heater 13000 in each of the plurality of cleaning modes. Accordingly, the aerosol generating device 10000 may improve the user's cleaning satisfaction regardless of a frequency of cleaning, while maintaining its durability.

Returning to FIG. 3, according to some exemplary embodiments, the controller 12000 may apply a plurality of threshold numbers to set the cleaning mode to one of the plurality of cleaning modes. For example, if the number of times that the cleaning operation has been performed in the past during the first period is greater than or equal to a second threshold number but less than the first threshold number of times, the controller 12000 may set the cleaning operation to a first enhanced cleaning mode. If the number of times that the cleaning operation has been performed in the past during the first period is less than the second threshold number, the controller 12000 may set the cleaning operation to a second enhanced cleaning mode.

For example, assuming that the first period is a period corresponding to 100 times of use, the first threshold number is 3, and the second threshold number is 1. In this case, if the number of times that the cleaning operation has been performed during 100 times of use is greater than or equal to 3, the controller 12000 may set the cleaning operation to the normal cleaning mode. Also, if the number of times that the cleaning operation has been performed during 100 times of use is greater than or equal to one 1 but less than 3, the controller 12000 may set the cleaning operation to the first enhanced cleaning mode. If the number of times that the cleaning operation has been performed during 100 times of use is less than 1, that is, 0, the controller 12000 may set the cleaning operation to the second enhanced cleaning mode.

The second enhanced cleaning mode may be a cleaning mode of providing a greater total amount of heat to the heater 13000 than in the first enhanced cleaning mode, and the enhanced cleaning mode may be subdivided into the first enhanced cleaning mode and the second enhanced cleaning mode. According to an exemplary embodiment, the enhanced cleaning mode shown in FIG. 4 or 5 may correspond to the first enhanced cleaning mode, and the enhanced cleaning mode shown in FIG. 6 may correspond to the second enhanced cleaning mode. Because the enhanced cleaning mode shown in FIG. 4 or 5 adjusts one of a total heating time and a highest heating time, whereas the enhanced cleaning mode shown in FIG. 6 adjusts both a total heating time and a highest heating temperature, the enhanced cleaning mode shown in FIG. 6 may provide a greater total amount of heat to the heater 13000 than the enhanced cleaning mode shown in FIG. 4 or 5. However, exemplary embodiments are not limited thereto. It will be easily understood by one of ordinary skill in the art that the second enhanced cleaning mode and the first enhanced cleaning mode may have other appropriate heating patterns as long as the second enhanced cleaning mode can provide greater total amount of heat to the heater 13000 than the first enhanced cleaning mode.

According to another exemplary embodiment, the controller 12000 may use a plurality of pieces of performance history information to select one of the plurality of cleaning modes. For example, when the number of times that the cleaning operation has been performed in the past during the first period is greater than or equal to the first threshold number, the controller 12000 may set the cleaning operation to the normal cleaning operation. Also, if the number of times the cleaning operation has been performed in the past during the first period is less than the first threshold number but the number of times that the cleaning operation has been performed in the past during the second period is greater than or equal to the first threshold number, the controller 12000 may set the cleaning operation to the first enhanced cleaning mode. Further, if the number of times that the cleaning operation has been performed in the past during the second period is less than the first threshold number, the controller 12000 may set the cleaning operation to the second enhanced cleaning mode.

According to an exemplary embodiment, assuming that the first period is a period corresponding to 100 times of use, the second period is a period corresponding to 400 times of use, and the first threshold number is 1, the controller 12000 may set the cleaning operation to the normal cleaning mode if the number of times that the cleaning operation has been performed during 100 times of use is greater than or equal to 1. Also, the controller 12000 may set the cleaning operation to the first enhanced cleaning mode if the number of times that the cleaning operation has been performed during 100 times of use is 0 and a number of times that the cleaning operation has been performed during 400 times of use is greater than or equal to 1. Further, the controller 12000 may set the cleaning operation to the second enhanced cleaning mode if the number of times that the cleaning operation has been performed during 400 times of use is less than 1, that is, 0.

According to another exemplary embodiment, when the number of times that the cleaning operation has been performed in the past during the first period is greater than or equal to a third threshold number, the controller 12000 may set the cleaning operation to an idle mode. The idle mode may be a mode of outputting notification information without performing a cleaning operation. For example, if the number of times that the cleaning operation has been performed during 100 times of use is greater than or equal to 5, the controller 12000 may not perform a cleaning operation although a user input for performing a cleaning operation is received. In this case, the controller 12000 may output notification information that no cleaning operation can be performed, by using at least one of a display (for example, a LED display) and a motor included in the aerosol generating device 10000, instead of performing a cleaning operation.

The above-described exemplary embodiments have been individually described for convenience of description. However, the above-described exemplary embodiments may be not necessarily individually applied, and may be combined into an arbitrary appropriate combination and applied. An example of a case in which the above-described exemplary embodiments are applied in combination will be described in detail later with reference to FIG. 10.

In operation 340, the controller 12000 may perform a cleaning operation according to the set cleaning mode. As such, the controller 12000 may determine when the effect of cleaning in a normal cleaning mode is reduced based on information about a performance history of the cleaning operation. If a user input for performing a cleaning operation is received at the corresponding time, the controller 12000 may perform the cleaning operation in the enhanced cleaning mode that provides a greater total amount of heat than the normal cleaning mode. Also, when the controller 12000 may determine when the effect of cleaning in the enhanced cleaning mode is reduced based on information about a performance history of the cleaning operation. If a user input for performing a cleaning operation is received at the corresponding time, the controller 12000 may perform the cleaning operation in an additional enhanced cleaning mode that provides a greater total amount of heat than the enhanced cleaning mode.

According to the disclosure, because a plurality of cleaning modes provide a different total amount of heat, a consistent cleaning effect may be obtained regardless of a cleaning frequency or a performance history of a cleaning operation.

Also, according to the disclosure, because the idle mode is provided to prevent an excessive number of cleaning operations from being performed within a specific period, unnecessary power consumption may be minimized.

Figure 10:
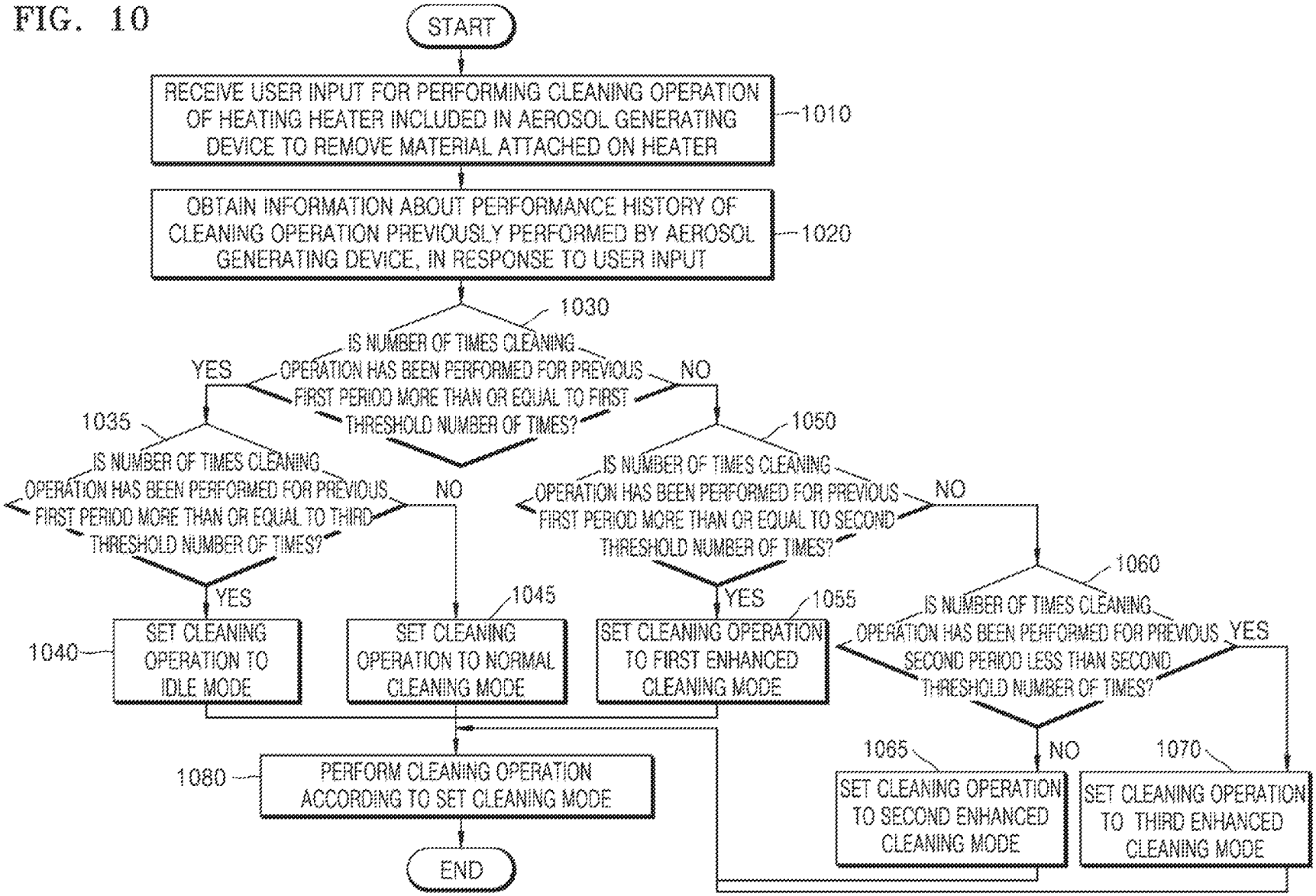
FIG. 10 is a flowchart showing another example of a method of cleaning an aerosol generating device according to some exemplary embodiments.

FIG. 10 is a flowchart showing another example of a method of cleaning the aerosol generating device according to some exemplary embodiments.

In FIG. 10, an exemplary embodiment of applying the plurality of threshold number of times, an exemplary embodiment of applying the plurality of pieces of performance history information, and an exemplary embodiment of applying the idle mode are applied in combination.

In operation 1010, the controller 12000 may receive a user input for performing a cleaning operation of heating the heater 13000 included in the aerosol generating device 10000 to remove a material attached on the heater 13000. Operation 1010 may correspond to operation 310 described above, and therefore, an overlapping description thereof will be omitted.

In operation 1020, the controller 12000 may obtain information about a performance history of the cleaning operation performed in the past by the aerosol generating device 10000, in response to the user input. Operation 1020 may correspond to operation 320 described above, and an overlapping description thereof will be omitted.

In operation 1030, the controller 12000 may determine whether a number of times that the cleaning operation has been performed in the past during the previous first period is greater than or equal to the first threshold number. When the controller 12000 determines that the number of times that the cleaning operation has been performed during the first period is greater than or equal to the first threshold number of times, the controller 12000 may perform operation 1035. Otherwise, when the controller 12000 determines that the number of times that the cleaning operation has been performed during the first period is less than the first threshold number, the controller 12000 may perform operation 1050.

In operation 1035, the controller 12000 may determine whether the number of times that the cleaning operation has been performed in the past during the first period is greater than or equal to the third threshold number. When the controller 12000 determines that the number of times that the cleaning operation has been performed during the first period is greater than or equal to the third threshold number of times, the controller 12000 may perform operation 1040. Otherwise, when the controller 12000 determines that the number of times that the cleaning operation has been performed during the first period is less than the third threshold number, the controller 12000 may perform operation 1045.

In operation 1040, the controller 12000 may set a mode of the cleaning operation to the idle mode.

In operation 1045, the controller 12000 may set a mode of the cleaning operation to the normal cleaning mode.

In operation 1050, the controller 12000 may determine whether the number of times that the cleaning operation has been performed in the past during the first period is greater than or equal to the second threshold number. When the controller 12000 determines that the number of times that the cleaning operation has been performed during the first period is greater than or equal to the second threshold number, the controller 12000 may perform operation 1055. Otherwise, when the controller 12000 determines that the number of times that the cleaning operation has been performed during the first period is less than the second threshold number, the controller 12000 may perform operation 1060.

In operation 1055, the controller 12000 may set a mode of the cleaning operation to the first enhanced cleaning mode that provides a greater total amount of heat to the heater 13000 than the normal cleaning mode.

In operation 1060, the controller 12000 may determine whether a number of times that the cleaning operation has been performed during the second period is less than the second threshold number. When the controller 12000 determines that the number of times that the cleaning operation has been performed during the second period is greater than or equal to the second threshold number, the controller 12000 may perform operation 1065. Otherwise, when the controller 12000 determines that the number of times that the cleaning operation has been performed during the second period is less than the second threshold number, the controller 12000 may perform operation 1070.

In operation 1065, the controller 12000 may set a mode of the cleaning operation to the second enhanced cleaning mode that provides a greater total amount of heat to the heater 13000 than the first enhanced cleaning mode.

In operation 1070, the controller 12000 may set a mode of the cleaning operation to a third enhanced cleaning mode that provides a greater total amount of heat to the heater 13000 than the second enhanced cleaning mode.

In operation 1080, the controller 12000 may perform the cleaning operation according to the set cleaning mode. As such, according to the disclosure, because the plurality of cleaning modes of providing a different total amount of heat according to heating patterns, a consistent cleaning effect may be obtained regardless of a cleaning frequency or a performance history of a cleaning operation. Also, because the idle mode is provided to prevent an excessive number of cleaning operations from being performed within a specific period, unnecessary power consumption may be minimized.

Those of ordinary skill in the art related to the present exemplary embodiments may understand that various changes in form and details can be made therein without departing from the scope of the characteristics described above. The disclosed methods should be considered in descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. A method of cleaning an aerosol generating device, the method comprising:

receiving a user input for performing a cleaning operation to remove material attached on a heater in the aerosol generating device by heating the heater;

reading information about a performance history of the cleaning operation previously performed by the aerosol generating device from a memory of the aerosol generating device, in response to the user input;

setting a mode of the cleaning operation differently based on the information about the performance history by selecting one of a plurality of cleaning modes of the aerosol generating device; and performing the cleaning operation according to the set cleaning mode, wherein the information about the performance history includes a number of times that the cleaning operation has been performed during a pre-set period, a period corresponding to a pre-set number of uses, a period corresponding to a pre-set number of puffs, or a period corresponding to a pre-set number of times of heating, wherein the setting of the mode of the cleaning operation comprises setting the cleaning operation to an idle mode based on a number of times that the cleaning operation has been performed during a first period being greater than or equal to a preset threshold number, and wherein the aerosol generating device outputs notification information without performing the cleaning operation in the idle mode.

2. The method of claim 1, wherein the information about the performance history includes at least one of the number of times that the cleaning operation has been performed during the first period and a number of times that the cleaning operation has been performed during a second period that is longer than the first period.

3. The method of claim 1, wherein the plurality of cleaning modes include a normal cleaning mode and an enhanced cleaning mode, and the enhanced cleaning mode provides a greater total amount of heat to the heater than the normal cleaning mode.

4. The method of claim 1, wherein the plurality of cleaning modes heating pattern.

5. The method of claim 4, wherein the heating pattern is determined based on at least one of a total heating time of the heater, a highest heating temperature of the heater, an inclination of a heating temperature of the heater, a number of times that the heater is heated to a specific temperature or higher, and a period during which the heater is heated at a specific temperature.

6. The method of claim 5, wherein the total heating time has a range of 25 seconds to 60 seconds, and the highest heating temperature has a range of 450° C. to 600° C.

7. The method of claim 1, wherein the setting of the mode of the cleaning operation comprises:

setting the cleaning operation to a normal cleaning mode based on the number of times that the cleaning operation has been performed during the first period being is greater than or equal to a first threshold number; and setting the cleaning operation to an enhanced cleaning mode based on the number of times that the cleaning operation has been performed during the first period being less than the first threshold number.

8. The method of claim 7, wherein the enhanced cleaning mode comprises a first enhanced cleaning mode and a second enhanced cleaning mode that provides a greater total amount of heat to the heater than the first enhanced cleaning mode, and the setting of the cleaning operation to the enhanced cleaning mode comprises:

setting the cleaning operation to the first enhanced cleaning mode based on the number of times that the cleaning operation has been performed during the first period being greater than or equal to a second threshold number and less than the first threshold number; and setting the cleaning operation to the second enhanced cleaning mode based on the number of times that the cleaning operation has been performed during the first period being less than the second threshold number.

9. The method of claim 1, wherein the setting of the mode of the cleaning operation comprises:

setting the cleaning operation to a normal cleaning mode based on the number of times that the cleaning operation has been performed during the first period being is greater than or equal to a first threshold number;

setting the cleaning operation to a first enhanced cleaning mode based on the number of times that the cleaning operation has been performed during the first period being less than the first threshold number of times and a number of times that the cleaning operation has been performed during a second period being greater than or equal to the first threshold number; and setting the cleaning operation to a second enhanced cleaning mode based on the number of times that the cleaning operation has been performed during the second period being less than the first threshold number.

10. A non-transitory computer-readable recording medium storing a program for executing the method of claim 1.

11. An aerosol generating device comprising:

a memory;

a battery configured to supply power to the aerosol generating device;

a heater configured to be heated when the power is supplied from the battery;

a controller configured to control the battery and the heater, wherein the controller is further configured to:

receive a user input for performing a cleaning operation of heating the heater to remove material attached on the heater, read information about a performance history of the cleaning operation previously performed by the aerosol generating device from the memory, in response to the user input, set a mode of the cleaning operation differently based on the information about the performance history by selecting one of a plurality of cleaning modes of the aerosol generating device, and perform the cleaning operation according to the set cleaning mode, and wherein the information about the performance history includes a number of times that the cleaning operation has been performed during a pre-set period, a period corresponding to a pre-set number of uses, a period corresponding to a pre-set number of puffs, or a period corresponding to a pre-set number of times of heating, wherein the setting of the mode of the cleaning operation comprises setting the cleaning operation to an idle mode based on a number of times that the cleaning operation has been performed during a first period being greater than or equal to a preset threshold number, and wherein the aerosol generating device outputs notification information without performing the cleaning operation in the idle mode.

* * * * *